US011982062B2

(12) United States Patent
Michel et al.

(10) Patent No.: US 11,982,062 B2
(45) Date of Patent: May 14, 2024

(54) SWEEPING BLADE DEVICE WITH ADJUSTABLE BLADES

(71) Applicant: USINAGE PRO24 INC., Asbestos (CA)

(72) Inventors: Hugo Michel, Asbestos (CA); Marco Bergeron, Asbestos (CA); Stephan Michel, Asbestos (CA)

(73) Assignee: USINAGE PRO24 INC., Quebec (CA)

( * ) Notice: Subject to any disclaimer, the term of this patent is extended or adjusted under 35 U.S.C. 154(b) by 634 days.

(21) Appl. No.: 17/087,868

(22) Filed: Nov. 3, 2020

(65) Prior Publication Data

US 2021/0047793 A1 Feb. 18, 2021

Related U.S. Application Data

(62) Division of application No. 16/068,240, filed as application No. PCT/CA2017/050082 on Jan. 26, 2017, now Pat. No. 10,883,237.

(60) Provisional application No. 62/287,139, filed on Jan. 26, 2016.

(51) Int. Cl.
*E01H 5/06* (2006.01)

(52) U.S. Cl.
CPC ..... *E01H 5/062* (2013.01)

(58) Field of Classification Search
CPC ..... E01H 5/066; E01H 5/065; E01H 5/061; E01H 5/062
See application file for complete search history.

(56) References Cited

U.S. PATENT DOCUMENTS

| | | | |
|---|---|---|---|
| 204,031 | A | 5/1878 | Gruntler |
| 520,479 | A | 5/1894 | Bunnell |
| 1,383,409 | A | 7/1921 | Liddell |
| 2,055,291 | A | 9/1936 | Henry |

(Continued)

FOREIGN PATENT DOCUMENTS

| | | |
|---|---|---|
| CA | 1233983 | 3/1988 |
| CA | 2110949 | 6/1995 |

(Continued)

OTHER PUBLICATIONS

Communication Pursuant To Article 94(3) EPC; dated Oct. 21, 2020.

*Primary Examiner* — Jessica H Lutz
(74) *Attorney, Agent, or Firm* — Bradley J. Thorson; DeWitt LLP

(57) ABSTRACT

A sweeping blade assembly for attachment to a vehicle for sweeping a ground surface. The sweeping blade assembly comprises: a blade support for receiving a plurality of blades, a first row of blades and a second row of blades. Each row of blade comprising a plurality of blades which are separated from each other by a gap. The first row of blades and the second row of blades are provided beside (and parallel to) each other and positioned so that a given gap in a given row corresponds to a blade in the other row. In an embodiment, the gap is dimensioned to be smaller in width than the blades whereby a given blade in one row can have a partial overlap of two different blades in the other row. Whereby, the blades can freely move vertically and/or angularly when hitting uneven surfaces, and can be rectangular in shape, and thus reversible when the carbide on one of the edges is worn out.

18 Claims, 8 Drawing Sheets

(56) References Cited

U.S. PATENT DOCUMENTS 2,116,351 A 5/1938 Jones et al.
2,762,139 A 9/1956 Launder
2,884,082 A 4/1959 Osterhaus
3,084,750 A 4/1963 Linden
3,160,967 A 12/1964 Nichols
3,400,475 A 9/1968 Peitl
3,454,108 A 7/1969 Skrukrud
3,455,041 A 7/1969 Roberts
3,465,456 A 9/1969 Meyer
3,514,830 A 6/1970 Takakita et al.
3,736,664 A 6/1973 Black et al.
3,772,803 A 11/1973 Cote
3,864,853 A 2/1975 Klett et al.
4,068,725 A 1/1978 Watson
4,159,584 A 7/1979 Niemela
4,166,640 A 9/1979 Van Denberg
4,265,358 A * 5/1981 Veenhof ..... B65G 45/12 15/256.5
4,288,932 A 9/1981 Kuper
4,305,272 A 12/1981 Johnson
4,307,523 A 12/1981 Reissinger et al.
4,570,366 A 2/1986 Yost
4,635,387 A 1/1987 Haring
4,669,205 A 6/1987 Smathers
4,671,363 A 6/1987 Bolinger
4,711,187 A 12/1987 Schultz
4,770,253 A 9/1988 Hallissy et al.
4,794,710 A 1/1989 Haring
4,944,104 A 7/1990 Kowalczyk
5,025,577 A 6/1991 Verseef
5,032,342 A 7/1991 Drabing et al.
5,140,763 A 8/1992 Nichols, IV
5,191,729 A 3/1993 Verseef
5,309,653 A 5/1994 Pease et al.
5,437,113 A 8/1995 Jones
5,456,323 A 10/1995 Hill
5,471,770 A 12/1995 Ferreira
5,477,600 A 12/1995 Houle et al.
5,636,458 A * 6/1997 Drake ..... E01H 5/066 37/270
5,697,172 A 12/1997 Verseef
5,715,613 A 2/1998 Ebert
5,743,032 A * 4/1998 Vauhkonen ..... E01H 5/062 172/701.3
5,746,017 A 5/1998 Marvik
5,778,572 A 7/1998 Lukavich et al.
5,813,474 A 9/1998 Manway
5,819,443 A * 10/1998 Winter ..... E01H 5/066 37/232
5,829,174 A 11/1998 Hadler et al.
5,881,480 A 3/1999 Fall
6,094,845 A 8/2000 Lela
6,145,858 A 11/2000 Foulquier
6,354,024 B1 3/2002 Kost et al.
6,854,527 B2 2/2005 Manway et al.
6,922,924 B2 * 8/2005 Jones ..... E02F 3/8152 37/457
7,107,709 B2 9/2006 Hamel
7,159,344 B2 * 1/2007 Karhi ..... E01H 5/061 37/232
7,467,485 B2 12/2008 Lachance et al.
7,631,441 B2 * 12/2009 Hunt ..... E01H 5/061 37/232
7,631,702 B2 12/2009 Hansen
7,665,234 B2 2/2010 Diehl et al.
8,191,287 B2 6/2012 Winter et al.
8,443,911 B2 * 5/2013 Tutschek ..... E02F 3/8152 172/701.3
8,887,413 B2 * 11/2014 Miller ..... E02F 3/815 37/444
8,984,778 B2 * 3/2015 Fox ..... E01H 5/062 37/266
9,121,151 B2 9/2015 Bergeron et al.
D824,962 S * 8/2018 Winter ..... D15/11
10,480,140 B2 * 11/2019 Vigneault ..... E01H 5/062
11,326,316 B1 * 5/2022 Condello ..... E01H 5/066
11,421,391 B2 * 8/2022 Desrochers ..... E01H 5/066
11,459,717 B2 * 10/2022 Côté ..... E01H 5/061
2001/0005949 A1 7/2001 Amano et al.
2002/0078604 A1 6/2002 Kost et al.
2003/0066210 A1 4/2003 Hollinrake et al.
2003/0182824 A1 10/2003 Coffin et al.
2003/0188463 A1 10/2003 Manway et al.
2003/0221338 A1 12/2003 Verseef
2004/0177534 A1 9/2004 Jones et al.
2006/0026870 A1 * 2/2006 Karhi ..... A61B 5/01 37/266
2006/0070264 A1 4/2006 Lachance et al.
2007/0256334 A1 11/2007 Schmeichel
2007/0271828 A1 11/2007 Mishra et al.
2009/0223090 A1 9/2009 Hunt
2009/0307934 A1 12/2009 Wendorff et al.
2013/0174452 A1 * 7/2013 Diehl ..... E01H 5/063 37/233
2013/0185962 A1 7/2013 Reeves
2015/0376850 A1 * 12/2015 Giletta ..... E01H 5/063 37/233
2016/0039030 A1 * 2/2016 Winter ..... B23K 1/19 219/615
2016/0333547 A1 * 11/2016 Winter ..... B29C 70/08
2017/0321390 A1 * 11/2017 Miller ..... E01H 5/065
2018/0100279 A1 * 4/2018 Aquino ..... E01H 5/061
2022/0136192 A1 * 5/2022 Weihl ..... E01H 5/062 37/197
2022/0243411 A1 * 8/2022 Vigneault ..... E01H 5/062
2023/0010870 A1 * 1/2023 Roberge ..... E01H 5/065
2023/0068800 A1 * 3/2023 Frey ..... E01H 5/062

FOREIGN PATENT DOCUMENTS

CA 2401809 3/2003
CA 2423830 7/2003
CA 2479905 3/2006
CA 2542919 10/2007
CA 2712715 2/2012
CA 2712715 A1 * 2/2012 ..... E01H 5/062
CA 2712716 2/2012
CA 2856940 6/2012
CA 3156874 A1 * 3/2023 ..... E01H 5/066
DE 881200 6/1953
DE 7141159 7/1972
DE 2164525 6/1973
DE 2437723 12/1986
DE 4441654 6/1995
DE 10261421 7/2004
DE 102005040705 3/2007
EP 1234915 8/2002
EP 1247906 10/2002
EP 2154294 A1 * 2/2010 ..... E01H 5/061
EP 2495368 9/2012
FR 1243526 9/1960
FR 1255480 1/1961
FR 2539438 7/1984
FR 2656017 6/1991
GB 2502273 11/2013
JP H07034426 2/1995
SE 454279 4/1988
WO 199528526 10/1995
WO WO-9528526 A1 * 10/1995 ..... E01H 5/061
WO 2011123956 10/2011
WO 2012070943 5/2012
WO WO-2012070943 A1 * 5/2012 ..... E01H 5/062
WO WO-2016058106 A1 * 4/2016 ..... E01H 5/062
WO WO-2017127928 A1 * 8/2017 ..... E01H 5/062

* cited by examiner

SWEEPING BLADE DEVICE WITH ADJUSTABLE BLADES

CROSS-REFERENCED TO RELATED APPLICATIONS

This application is a divisional patent application of Ser. No. 16/068,240, filed Jul. 5, 20218, and which was a national phase entry of PCT Patent Application Serial No. PCT/CA2017/050082, filed Jan. 26, 2017, designating the United States of America.

(A) FIELD

The subject matter disclosed generally relates to sweeping blade devices.

(B) RELATED PRIOR ART

Snowplowing vehicles are well known in countries that experience significant snowfall and severe cold. Such vehicles include a sweeping blade which travels over the surface of a substrate such as a road, airport, runway, parking lot or the like for removing snow, ice and debris.

The typical challenge of these vehicles is the presence of uneven surfaces and obstacles on the road especially those of a protruding nature e.g. bumps, which cause uneven wear and premature damage to the blade and/or the entire assembly accompanied by an uneven cleaning of the areas surrounding the protruding obstacle.

Attempts have been made to address this problem. For example, FIG. 1 illustrates the sweeping blade assembly 10 described and shown in co-owned U.S. Pat. No. 9,121,151, and FIG. 1A illustrates a conventional sweeping blade device used in the system of FIG. 1A. This sweeping blade assembly 10 allows for a limited angular movement of a given blade with respect to the adjacent ones as exemplified in FIG. 2.

In particular, this reference describes first and second horizontal blade supports 16 and 18 defining a vertical channel in between them for receiving sweeping blade devices 14. The sweeping blade devices are provided beside each other in the channel with little distance between them. The little angular movement permitted in this system is permitted by the fact that the blades are tapered on top and define a trapezoidal shape as exemplified in FIG. 1A, whereby if the blade moves angularly (rotates clockwise or counterclockwise) it would not be blocked or stopped by the top portion of the adjacent blade since the distance between the top portions is greater than the distance between the lower portions of the blades as exemplified in FIG. 7*a*.

While the system described in U.S. Pat. No. 9,121,151 is an improvement over its prior devices, the movement of the blades is still limited and does not allow for an efficient cleaning of the surface surrounding the obstacle. Furthermore, movement of the blades may result in the creation of interstices which let snow pass therethrough, thereby leaving snow traces inside the plowed area. Moreover, the blades used in this system cannot be reversed due to their tapered top, which means that once the carbide is worn on the lower edge of the blade, the entire blade would have to be changed.

Therefore, there remains a need in the market for a sweeping blade assembly which reduces the effect of protruding obstacles on the blades as well as on the snow removal procedure in the areas that surround the protruding obstacle.

SUMMARY

In one aspect, there is provided a sweeping blade assembly for attachment to a vehicle for sweeping a ground surface, the sweeping blade assembly comprising a first row of blades comprising a plurality of first-row blades spaced apart by a first-row gap; a second row of blades comprising a plurality of second-row blades spaced apart by a second-row gap, and a blade support for receiving the first row of blades and the second row of blades thereon; wherein the blades are configured to move vertically and/or angularly when contacting uneven surfaces; and wherein the first row of blades and the second row of blades are provided side by side and positioned so that a given first-row gap corresponds to a second-row blade and vice versa for allowing a free movement of the blades when contacting uneven surfaces.

In one embodiment, a given first-row blade is wider than a given second-row gap such that the given first-row blade completely overlaps the given second-row gap and partially overlaps two second-row blades which are separated by the given second-row gap.

In one embodiment, the blades in a given row are rectangular in shape and are configured to have a free angular movement without coming in contact with other blades of the given row.

In one embodiment, each one of the blades comprises a first layer of carbide on a lower edge of the blade and a second layer of carbide on an upper edge of the blade, the blades being removeably attachable to the blade support and being reversible to sweep the ground with the second layer of carbide when the first layer of carbide is worn out.

In one embodiment, the blades are attached to the blade support using compressible bushings.

In one embodiment, each blade comprises two bushing holes, each bushing hole comprising a resilient material bushing and a metal bushing, the metal bushing being for connecting to the blade support and the resilient material bushing being configured to surround the metal bushing for preventing metal to metal contact between the blade and the blade support.

In one embodiment, the resilient material bushing comprises one or more air gaps for increasing its compressibility, and thus, a movement flexibility of the blade.

In one embodiment, each blade comprises two bushings, and wherein a substantially equal compression/decompression of the two bushings results in a vertical movement of the blade, and a differential compression of the bushings results in an angular movement of the blade.

In one embodiment, a first width of the first-row gap and a second width of the second row gap are substantially equivalent.

In one embodiment, the first-row blades and the second row blades have similar dimensions.

In another aspect, there is provided a vehicle comprising a sweeping blade assembly according to the present embodiments.

In another aspect there is provided a sweeping blade assembly for attachment to a vehicle for sweeping a ground surface, the sweeping blade assembly comprising: a blade support for receiving blades; a first row of blades comprising a plurality of first-row blades which are attached directly onto the blade support and being separated from each other by a first-row gap; a second blade support comprising a plurality of second-row blades which are attached to the blade support and being distant from the blade support by the first row of blades, and being separated from each other by a second-row gap; wherein each one of the first-row gaps is covered by a corresponding one of the second-row blades, thereby preventing formation of an interstice when a blade undergoes movement.

In one embodiment, the blades are rectangular in shape and reversible.

In another embodiment the blades are attached to the blade support using compressible bushings which allow for limited free movement of the blade in an angular manner and/or in a vertical manner.

In another aspect, there is provided a sweeping blade assembly comprising: a blade support; a plurality of blades removeably attached to the blade support using compressible bushings and having a substantially rectangular shape, wherein adjacent ones of the blades are arranged in distinct planes to allow angular movement of the blades; and wherein each one of the plurality of blades has two sweeping edges to provide reversibility.

In another aspect there is provided a snow plow blade assembly for sweeping snow, the snow plow blade assembly comprising: a first row of blades comprising a plurality of first-row blades spaced apart by a first-row gap: a second row of blades comprising a plurality of second-row blades spaced apart by a second-row gap; wherein each blade is attached to the blade support by a bushing assembly comprising a resilient material, whereby each blade can undergo limited and independent movement with respect to the blade support; wherein each one of the first-row gaps is covered by a corresponding one of the second-row blades, thereby preventing formation of an interstice when a blade undergoes movement.

In another aspect, there is provided a snow plow blade assembly for sweeping snow, the sweeping blade assembly comprising: a plurality of blades having a substantially rectangular shape, adjacent ones of the blades being arranged in distinct planes to allow angular movement of the blades; wherein each one of the plurality of blades has two sweeping edges to provide reversibility.

The expression "blade portion" is intended to mean a blade made of a material resilient or not. Examples include, without limitations, wide range of composite materials, steel, carbide as defined below, aluminum, alloys, polymers, plastics, and the like.

The expression "carbide" is intended to mean a compound composed of carbon and a less electronegative element. Carbides can be generally classified by chemical bonding type as follows: (i) salt-like, (ii) covalent compounds, (iii) interstitial compounds, and (iv) "intermediate" transition metal carbides. Examples include, without limitations, calcium, carbide, silicon carbide, tungsten carbide (often called simply carbide), and cementite.

The expression "resilient material" is intended to mean a material which absorbs energy when it is deformed elastically and then, when the force causing the deformation is removed, unloads this energy by substantially taking back its initial shape. Examples include, without limitations, natural rubber, polymeric material, a wide range of composite material and the like.

The expression "rubber material" is intended to mean a material in which bond lengths deviate from the equilibrium (minimum energy) and strain energy is stored electrostatically. Examples include, without limitations, compositions of nitrile, hydrogenated nitrile, ethylene-propylene fluorocarbon, chloroprene, silicone, fluorosilicone, polyacrylate, ethylene acrylic, styrene-butadiene, polyurethane, rubber material and the like.

Features and advantages of the subject matter hereof will become more apparent in light of the following detailed description of selected embodiments as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which:

FIG. 86 is a side view of the blade assembly of FIG. 8A without elevation and showing an obstacle in front of the blade assembly:

It will be noted that throughout the appended drawings, like features are identified by like reference numerals.

DETAILED DESCRIPTION

The embodiments describe a sweeping blade assembly for attachment to a vehicle for sweeping a ground surface. The sweeping blade assembly comprises: a blade support for receiving a plurality of blades, a first row of blades and a second row of blades. Each row of blade comprising a plurality of blades which are separated from each other by a gap. The first row of blades and the second row of blades are provided beside (and parallel to) each other and are positioned so that a given gap in a given row corresponds to (faces) a blade in the other row, and vice versa. In an embodiment, the gap is dimensioned to be smaller in width than the blades whereby a given blade in one row can have a partial overlap of two different blades in the other row. Whereby, the blades can freely move vertically and/or angularly when hitting uneven surfaces, and can be rectangular in shape, and thus, reversible when the carbide on one of the edges is worn out.

Figure 3:
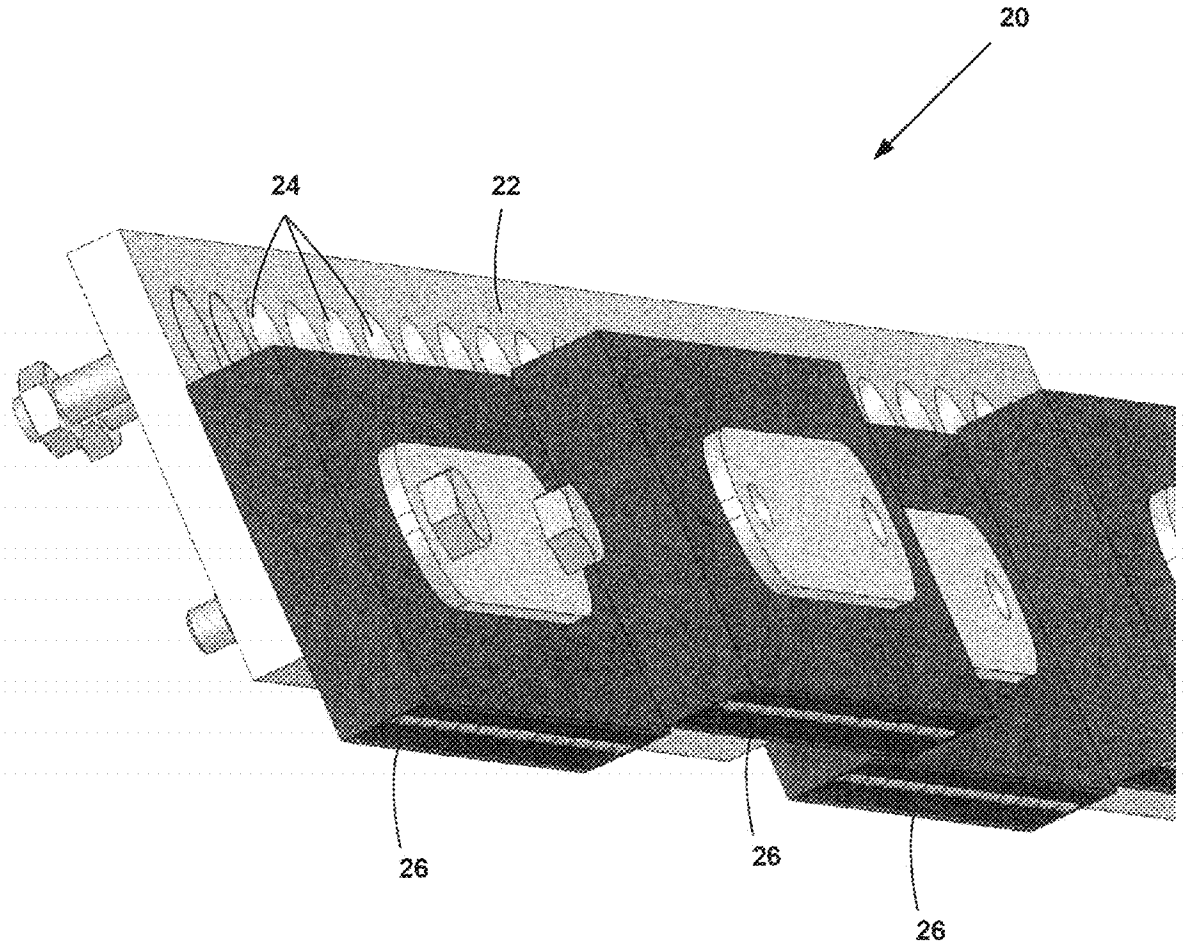
FIG. 3 illustrates an example of a sweeping blade assembly in accordance with an embodiment.

FIG. 3 illustrates an example of a sweeping blade assembly 20 in accordance with an embodiment.

Figure 4:
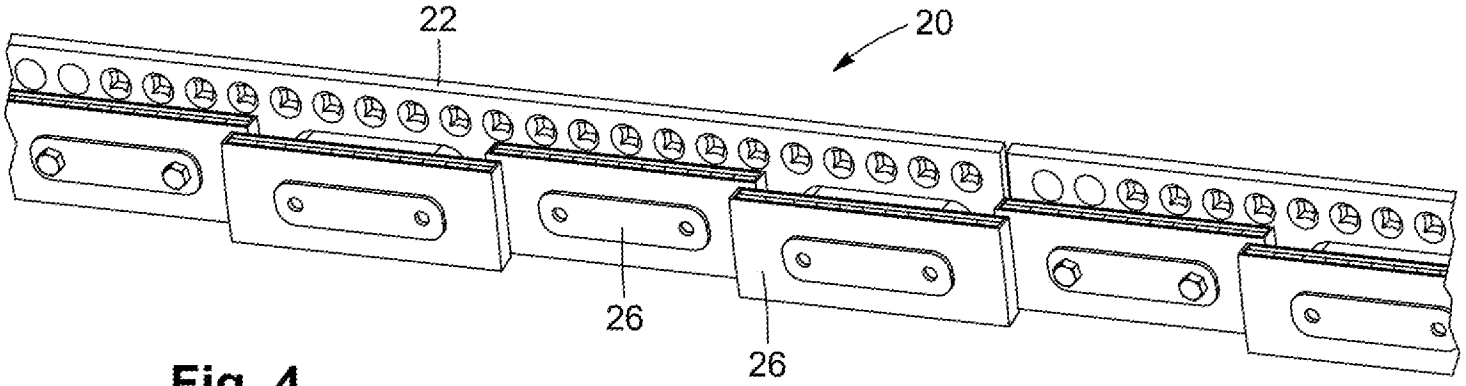
FIG. 4 is a side elevational view of the sweeping blade assembly of FIG. 3.

As exemplified in FIG. 3, the sweeping blade assembly 20 comprises a blade support 22 comprising a plurality of apertures 24 extending along the length of the blade support 22, and a plurality of sweeping blade devices 26 (aka blades 26) operably connected to the blade support 22. According to an embodiment, the blade 26 is removably attached to the blade support 22 with attaching means, such as nuts and bolts, as shown in FIGS. 3-4. In this attaching means is found a bushing assembly 15, comprising a bushing 17 and a bushing hole 19 (illustrated and discussed in more detail with respect to FIG. 6B).

The sweeping blade assembly 20 is generally for attachment to a plough board (not shown) which is operatively attached to a vehicle and adapted to be moved controllably from the inside of the vehicle to be at least lowered and raised for snowplowing purposes. Other embodiments allow for rotating the assembly along different axes for dealing with difficult/irregular spots.

In an embodiment, the sweeping blade assembly 20 comprises two (or more) rows of blades 26, each row comprising a plurality of blades 26 arranged in a manner that allows for rotation and translation (i.e., angular (rotation with respect to the bushings), horizontal and vertical movements) of each blade 26 without being restricted by the adjacent blade 26 as in the prior art. At rest, each blade 26 extends along a given plane in space; other blades which extend in the same plane as a first blade belong to the same row. The other blades which extend in another plane (which is usually parallel to the first one but does not coincide therewith) belong to the second row.

In other words, the sweeping blade assembly 20 comprises a plurality of blades 26, which belong to a first or a second row. Adjacent sweeping blade devices 26 of the same row are separated by a gap to avoid preventing or restricting rotation and translation of a blade 26. The gap defined between two adjacent blades 26 of a given row has a corresponding blade of the other row which covers the gap, or is underlying the gap, thereby avoiding any slots or interstices that would result from the presence of a gap without any corresponding blade. The gap is dimensioned to allow sufficient angular and translational (horizontal and/or vertical) movement, as permitted by the bushing assembly.

Figure 5:
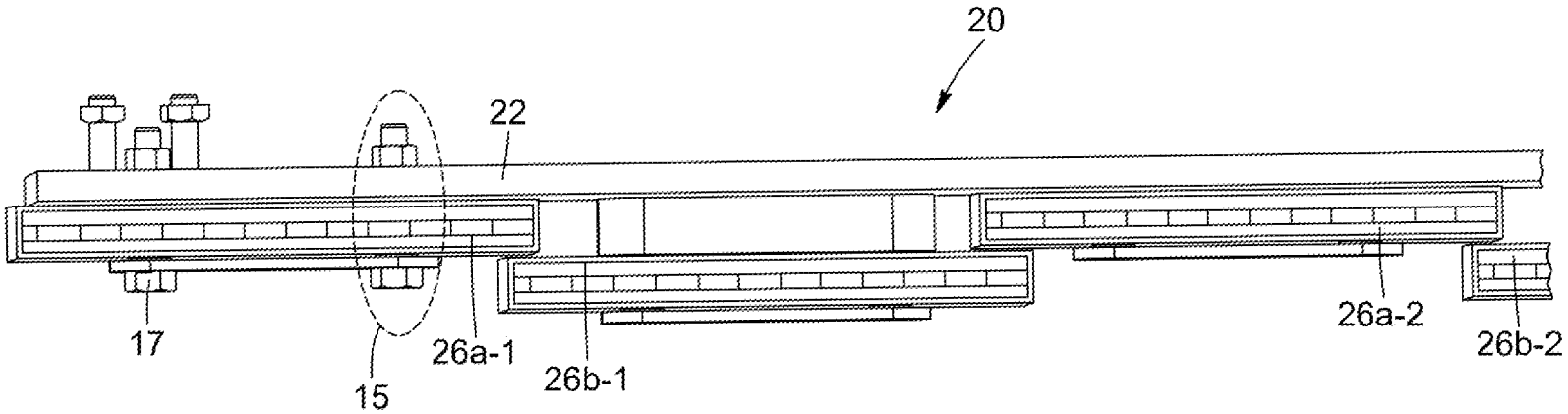
FIG. 5 is a top view of the sweeping blade assembly of FIG. 3.

FIG. 5 shows two rows of blades 26. The first row is formed by blade 26*a*-1 and blade 26*a*-2. The second row is formed by blade 26*b*-1 and blade 26*b*-2. Neighboring blades within the same row are separated by a gap which extends along a given length and are characterized by a width. The gap in the first row between blade 26*a*-1 and blade 26*a*-2 is illustrated clearly in FIG. 5.

The length of the gap is shown as a substantially large fraction of the length of the blade 26*b*-1. As illustrated in FIG. 5, there is an overlap between the first row blades and the second row of blades. As shown, blade 26*b*-1, of the second row, has a small surface in common with blade 26*a*-1, and a small surface in common with blade 26*a*-2. There is thus an overlap on both sides of the blade 26*b*-1, which allows the blade 26*b*-1 to completely cover the gap formed between them.

Providing an overlap on both sides of all blades of the second row on the corresponding blades of the first row implies that the first row of blades and the second row of blades together form an uninterrupted frontline (when seen from the front), as there is no interstice formed between blades. It means that when the sweeping blade assembly is used to plow snow, there is no snow trace left behind inside the area that has been plowed.

Figure 1:
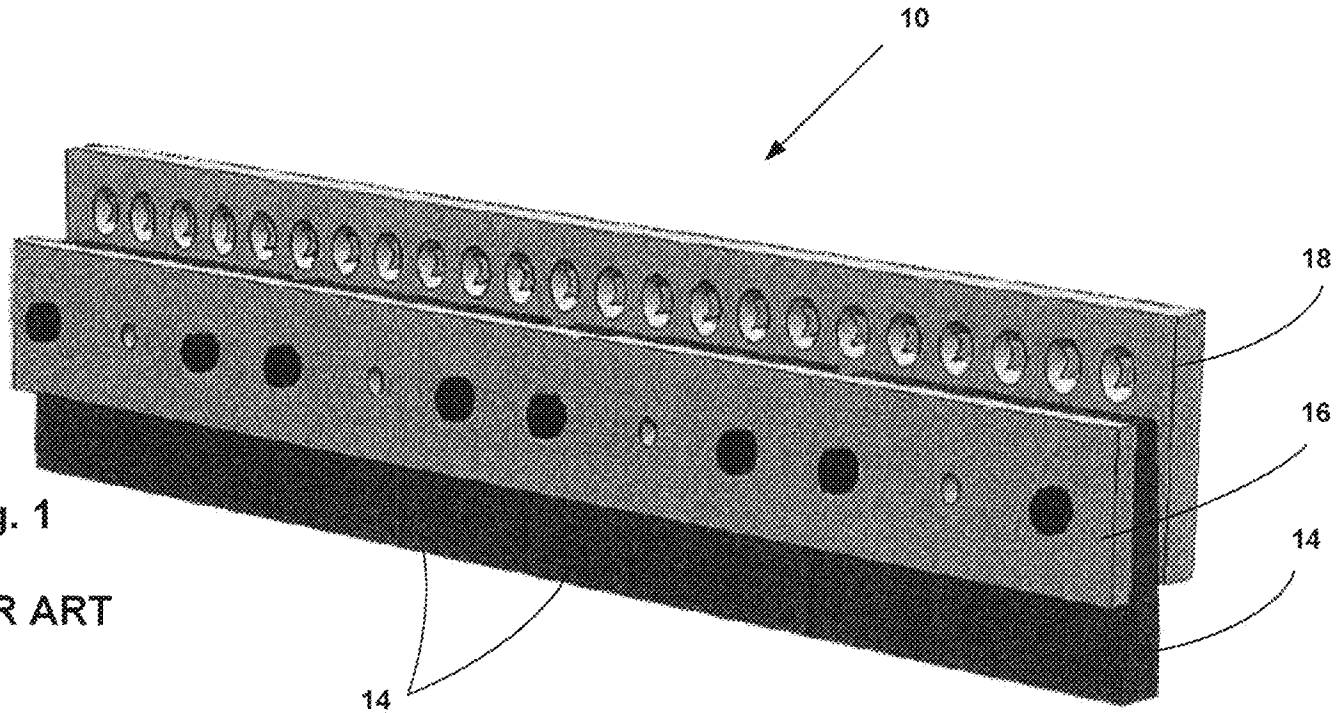
Fig. 1 PRIOR ART
FIG. 1 illustrates a conventional sweeping blade assembly.
Figure 1A:
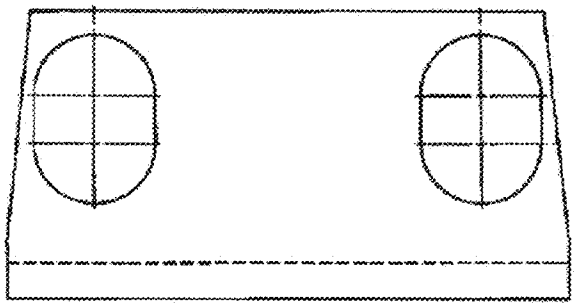
Fig. 1A PRIOR ART
FIG. 1A illustrates a conventional sweeping blade device used in the system of FIG. 1A.
Figure 2:
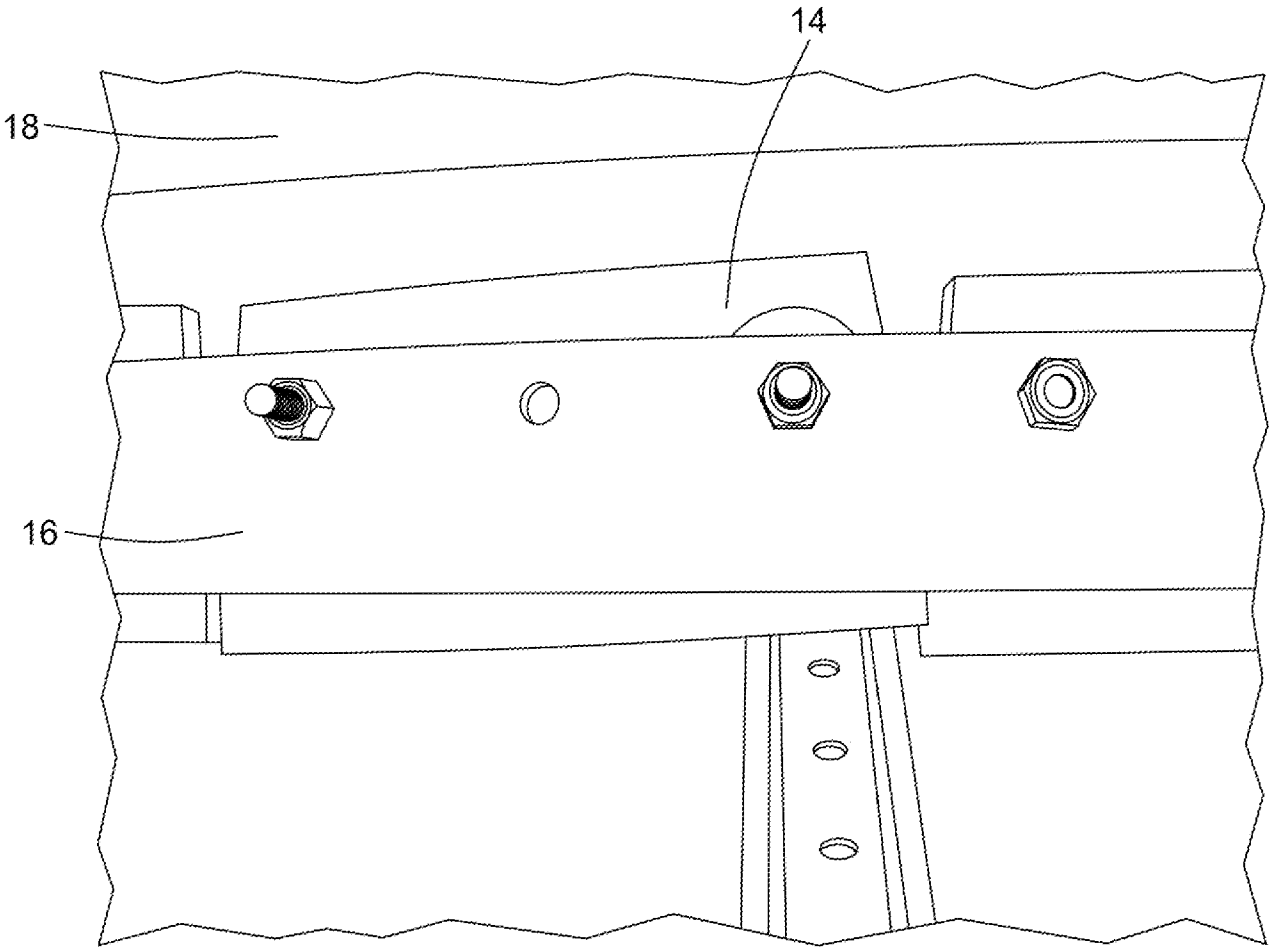
Fig. 2 PRIOR ART
FIG. 2 illustrates the limited angular movement of a given blade in the conventional sweeping blade assembly of FIG. 1.

As a matter of comparison, FIGS. 1-2, which illustrate a prior art sweeping blade assembly, show that the frontline made up by the single row of blades can have interstices if one of the blades undergoes a horizontal movement different from its neighbors, or if it undergoes an angular movement. In such cases, an aperture between adjacent blades is created, leaving room through which snow permeates, thereby creating undesirable snow traces in the plowed area.

The sweeping blade assembly 20 provides two rows of blades such that if a given blade of the second row (or of the first row) undergoes a substantial translation and/or rotation, it is backed up by the blades of the first row (or of the second row, respectively) that the given blade overlaps.

For example, if blade 26*b*-1, due to protuberances on the ground, undergoes substantial translation and/or rotation, the presence of blades 26*a*-1 and 26*a*-2 will provide a back-up that prevents the creation of an interstice therebetween. This is made possible by the overlap of blade 26*b*-1 on blades 26*a*-1 and 26*a*-2, or more generally, by the overlap of blades of the second row on the blades of the first row.

Even though there is no maximum limit on the overlap fraction, the overlap is preferably kept small to avoid wasting materials on widely overlapping blades. Too much overlap does not improve the efficiency of snow removal and may affect the rotation or translation of neighboring blades in the other row (i.e., those concerned by the overlap with one blade).

According to an embodiment, the overlap fraction is 5% on each side of the blade. In this example, the gap has a length of about 90% of the length of a blade. In most cases, the gap has a length that ranges between 70% and 90% of the length of the blade.

Because of this overlap, the gap cannot be thinner than the blades it separates, because the blade (from the other row) covering such a gap overlap (i.e., lies on) these blades.

Figure 6A:
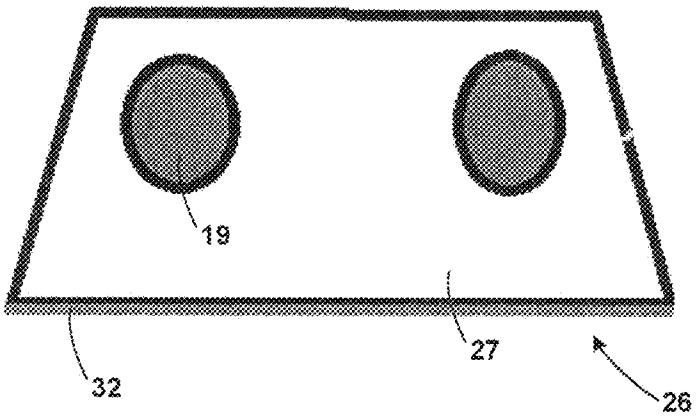
Fig. 6A PRIOR ART
FIG. 6A is a side view of a conventional blade.
Figure 6B:
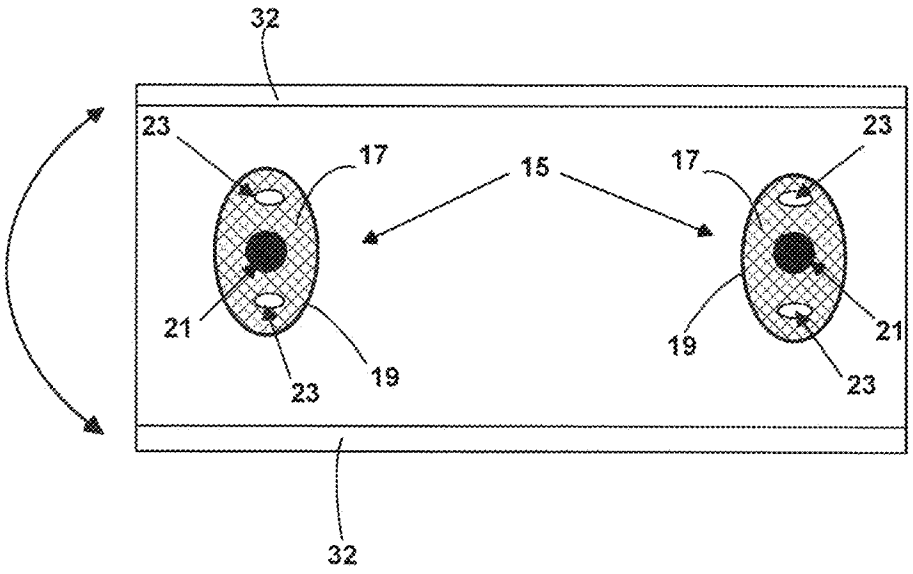
FIG. 6B is a side view of a blade in accordance with an embodiment.

Now referring to FIGS. 6A-6B, there are shown embodiments of a blade device 26 comprising a blade portion 27 (i.e., the area of the blade 26 used for sweeping as such, made of a material as listed in the above definitions), which comprises a sweeping edge 32 (i.e., the edge as such of the blade portion 27) for sweeping a ground.

With reference to FIG. 6B, there is shown an example of a bushing assembly 15 including a resilient material bushing 17 and a metal bushing 21 both being provided in a bushing hole 19. The resilient material bushing 17 may be configured to surround the metal bushing 21. The metal bushing 21 is used to operatively and detacheably/removeably secure the blade 26 to the blade support 22, whereby as the blade 26 vibrates and moves vertically and angularly in response to road obstacles, these vibrations and shocks are absorbed and/or dampened by the resilient material bushing 17 which is provided between the metal portion of the blade and the metal bushing 21 to avoid any metal to metal contact. In an embodiment, one or more airgaps 23 may be provided within the resilient material bushing 17 for improving the compressibility of the bushing assembly 15. This arrangement allows for increased movement flexibility of the blade 26, wherein, when both bushing assemblies 15 are compressed equally or substantially equally, the blade 26 may move vertically upward to avoid the obstacle and reduce its impact on the entire assembly 20. Whereas when the obstacle happens to be closer to one bushing assembly 15 than the other e.g. when the obstacle is between two adjacent blades, the differential compression of the one bushing assembly 15 will cause the blade 26 to move angularly and rotate to one side to reduce the impact of the obstacle onto the sweeping blade assembly 20 as exemplified in FIGS. 8A to 8D.

Figure 8A:
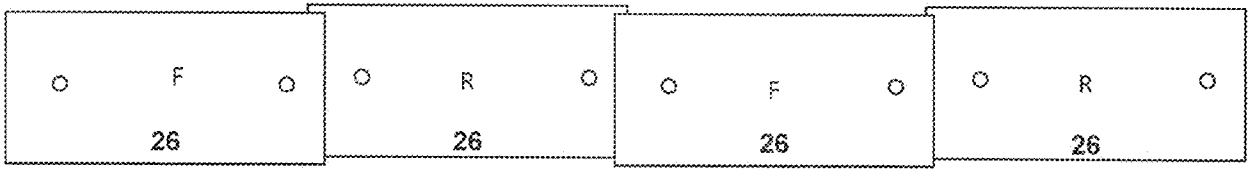
FIG. 8A is a side elevational view of a blade assembly in accordance with an embodiment.
Figure 8B:
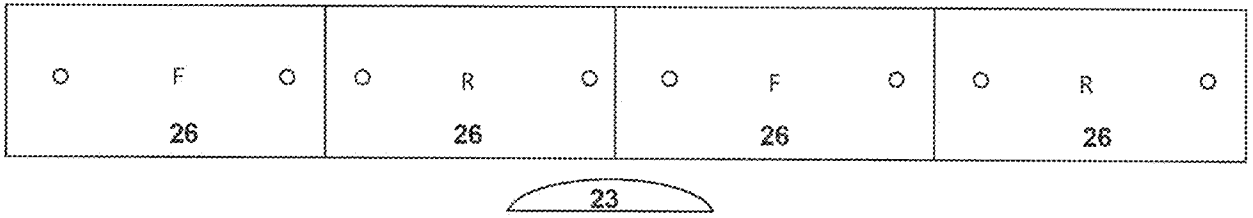
FIG. 8C illustrates the assembly of FIG. 8B at the time of hitting the obstacle.
FIG. 8D is a 3D illustration showing a side elevational view of an exemplary sweeping blade assembly at the time of hitting the obstacle.
Figure 8C:
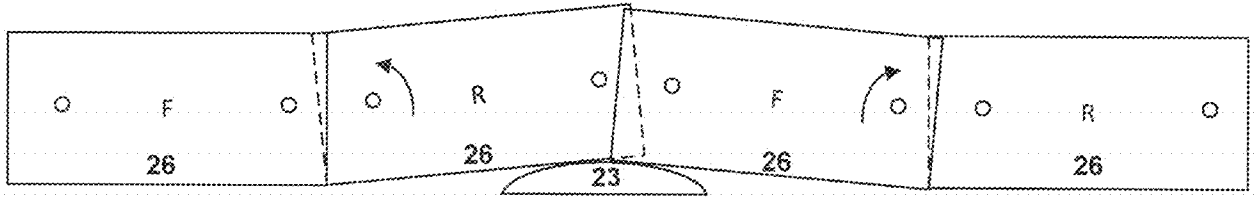
Figure 8D:
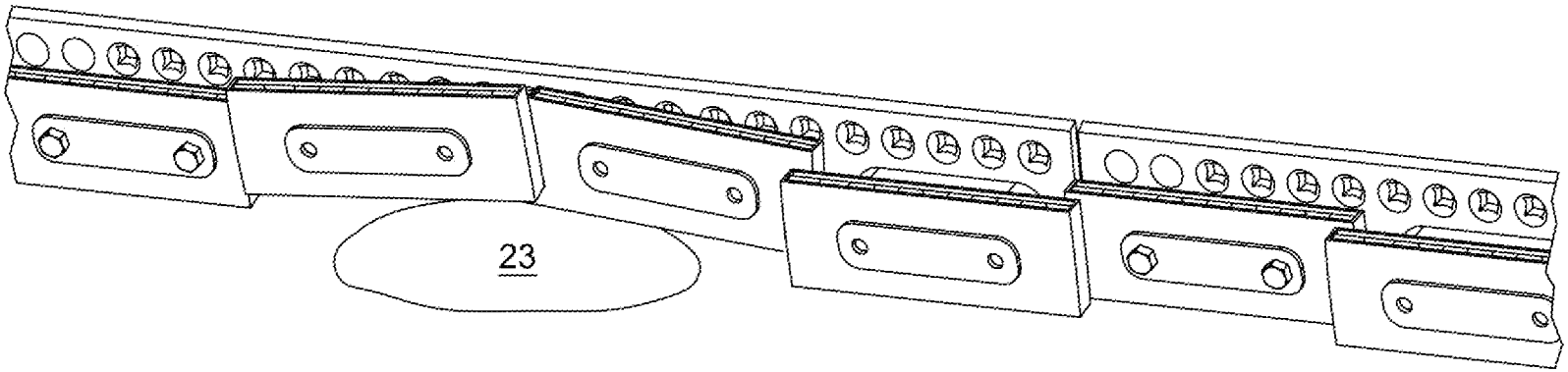

FIGS. 8A to 8D illustrate an exemplary movement of the blades when the sweeping blade assembly hits a road obstacle (uneven surface). FIG. 8A is a side elevational view of a blade assembly in accordance with an embodiment. As shown in FIG. 8A, two rows of blades 26 are illustrated, wherein blades pertaining to the front row are marked with the letter F and those pertaining to the rear row are marked with the letter R. As clearly shown the front blades F do overlap a portion of the rear blades R. FIG. 8B is a side view of the blade assembly of FIG. 8A without elevation showing an obstacle 23 in front of the blade assembly. FIG. 8C illustrates the assembly of FIG. 88 at the time of hitting the obstacle 23. FIG. 8D is a 3D illustration showing a side elevational view of an exemplary sweeping blade assembly at the time of hitting the obstacle. As exemplified in FIG. 8C the front blade 26 rotates clockwise around the right bushing while the rear blade 26 rotates counterclockwise around the left bushing. Due to the presence of a gap on the left and right sides of each blade and the double row arrangement, the blades of the different rows can be made in a rectangular shape and be configured to be reversible without limiting their rotation/angular movement.

The blade portion 27 of the blade device 26 may be coated with a layer 18 of a resilient material. As an example, the resilient material for the layer 18 may be made of rubber composition material.

As explained below, the blade device 26 comprises bushing holes 19 which cooperate with corresponding bushings 17 to provide attachment of the blade device 26 belonging to a given row to the blade support 22. A bushing hole 19 and bushing 17 together form a bushing assembly 15. Because materials used in the bushing assembly 15 are resilient materials and also because an airgap can be provided in the bushing hole 19, movement along various degrees of freedom is enabled, resulting in a possibility for a given blade device 26 to undergo rotation and/or translation with respect to the blade support 22, this movement being independent from the movement of the other blades, Indeed, the influence of a neighboring blade on the movement of a given blade is kept minimal due to the gap between adjacent blades in the same row. Rotation and translation of a given blade is mostly limited by the bushing assembly. Each blade is thus substantially free to move (rotate and translate) under the limits imposed by the bushing assembly. Under some circumstances, the amplitude of the movement enabled by the bushing assembly 15 may be so large that overlapping blades from the other row may prevent further movement.

It is to be noted that the sweeping blade device 14 include at least one bushing hole 19 opposite to the sweeping edge 32 (FIG. 6A), or provided along a horizontal central line of symmetry across the blade 26 (FIG. 6B). Usually, two bushing holes 19 are provided on a blade 26, as shown. The bushing 17 is made of a resilient material, as defined above, which may consist in a rubber composition material. It is to be noted that the bushing 17 and the bushing hole 19 allow a better absorption and the ability to accommodate uneven and different road surfaces without damaging the vehicle and the vehicle components. It is also to be noted that a metal to metal contact (without the bushing 17 and the bushing hole 19) results in an increase in wear and repair due to vibration which causes costs increase to the user of such a blade for removing snow from all kinds of roads and surfaces.

The bushing holes 19 may be of different shapes and/or configurations for increasing their ability to accommodate uneven and different road surfaces without damaging the vehicle and the vehicle components. The shape of the bushing hole 19 may be, without limitations, a circular shape, an elliptic shape, and the like. In a preferred embodiment, the shape of the bushing hole 19 is an eccentric shape.

According to an embodiment, the blade 26 has bushings 17 integrally formed thereto, for example, by molding. For example, a metal bushing can be installed in a resilient material bushing. The resilient material bushing allows the metal bushing to absorb vibration and vertical movement causing less wear and tear on the sweeping edge 32. A ventilation hole (aka airgap) in the blade 26 can be provided for more absorption of vibration and vertical movement of the blade 26, reducing wear and tear on the sweeping edge 32.

Advantageously, the blade can be provided with two carbide-coated sweeping edges 32 for increased durability. Having two sweeping edges 32 normally ensures that the blade lasts twice longer, which is advantageous for the user.

In order to provide two sweeping edges 32, the blade can be made to be reversible. According to an embodiment shown in FIG. 6B, the blade can have a rectangular shape to provide reversibility FIG. 6B further shows that the blade is symmetrical with respect to a horizontal axis. The blade can thus be provided with two sweeping edges, one on the bottom and the other one on the top of the blade. Indeed, reversibility is provided by having both the top and bottom edges with the same length. Because the blade is symmetrical, once one of the sweeping edges is worn out, the blade can be mounted upside down and the other sweeping edge, still unused, can be used instead, thereby substantially doubling the life time of a blade 26.

Figure 7A:
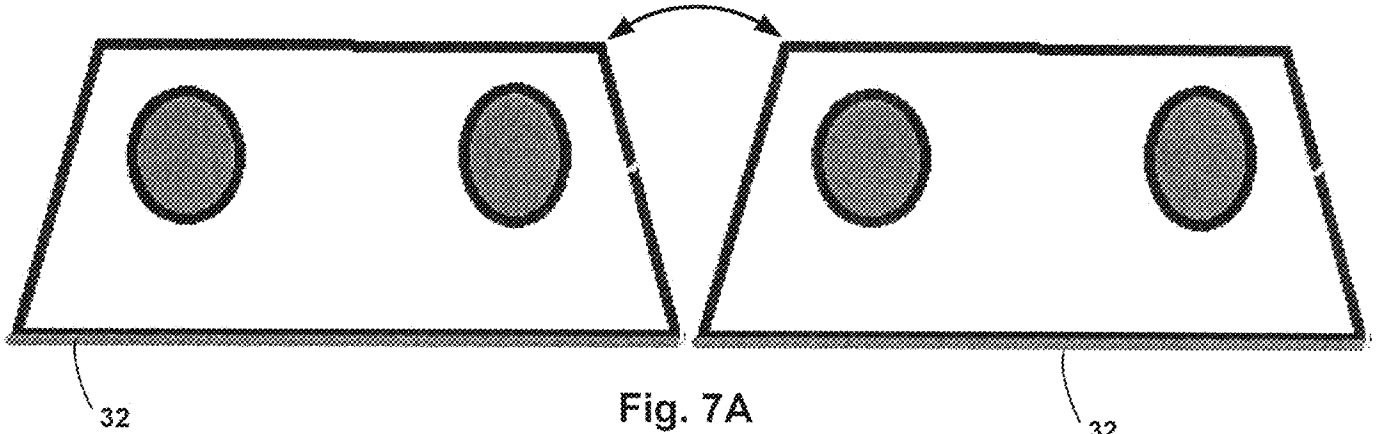
Fig. 7A PRIOR ART
FIGS. 7A and 7B are side views illustrating neighboring conventional trapezoidal blades and rectangular blades in accordance with an embodiment, respectively.
Figure 7B:
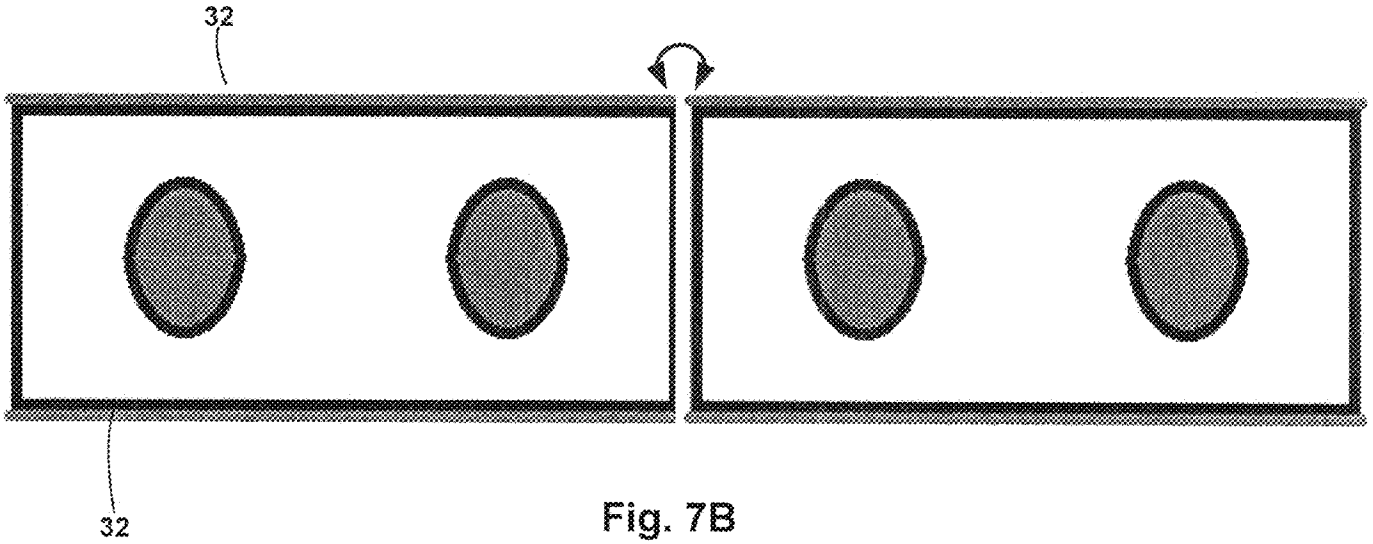

However, whereas trapezoidal blades (with only one sweeping edge per blade) had (to some extent) freedom to move angularly as shown in FIG. 7A the freedom of angular movement of adjacent rectangular blades arranged in a single plane is very much limited, as shown in FIG. 7B, where blades collide after a small angular movement. Therefore, in order to benefit from the advantages of reversible blades with two carbide-coated sweeping edges 32 per blade, which have a rectangular shape, it is preferable to arrange such blades in an alternating pattern in two planes as described above to avoid the limitations on angular movement that would result from having them directly side by side in the same plane.

Having longer lasting blades is thus made possible by having the blades reversible, resulting in a more economical product. Providing two carbide-coated sweeping edges 32 on a blade can be attained by using rectangular symmetrical blades that can accommodate both these edges, usually as a top edge and a bottom edge. However, this blade shape further limits the angular movement of the blades when blades are arranged side by side. The system described above, where neighboring blades are arranged in different or distinct planes, advantageously reduces these limits on the movement on the blades. This system with two rows of blades is thus advantageous for accommodating reversible rectangular blades.

Referring to the vehicle on which the sweeping blade assembly 20 is mounted, it is noted that the vehicle may be included in the group consisting of a truck, a car, a four-wheeler, a tractor, a personal vehicle, a commercial vehicle, a snow plow vehicle, a van and the like. The sweeping blade assembly 20 may be attached to the front, back or underneath of such vehicles. This sweeping blade assembly 20 may be used to remove snow from road surfaces or even earth in an agricultural field.

The adjustable sweeping blade assembly 20 for attachment to personal or commercial vehicles can improve the methods of snow removal, especially high speed snow removal, by, by minimizing vibrations on the equipment, thereby improving the wear life of the product and reducing the noise due to the roads surface contact effects, by reducing the fatigue encountered by the operator due to vibrations and noise, by improving roads and highways safety due to cleaner surfaces substantially free of snow lines or traces inside the plowed area, by reducing sand and salt consumption and by reducing marking wear on highways and roads.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A sweeping blade assembly for attachment to a vehicle having a sweeping blade support, the sweeping blade assembly comprising:

a first row of blades comprising a plurality of first-row blades securable to the blade support with adjacent ones of the first-row blades being spaced-apart from each other by a first-row gap; and a second row of blades comprising a plurality of second-row blades securable to the blade support with adjacent ones of the second-row blades being spaced-apart from each other by a second-row gap and being distant from the blade support by the first row of blades, wherein the second-row blades are movable with respect to the blade support independently of the first-row blades;

wherein each one of the first-row gaps is covered by a corresponding one of the second-row blades, thereby preventing formation of an interstice when a blade undergoes movement.

2. The sweeping blade assembly of claim 1, wherein the first-row blades and the second-row blades are substantially rectangular in shapes; and wherein the first-row gap has a first width and the second-row gap has a second width substantially equal to the first width of the first-row gap.at least partially concealed by the module casing and the module base.

3. The sweeping blade assembly of claim 1 wherein each one of the first-row blades and the second-row blades is removably securable to the blade support and has two opposed sweeping edges, each one of the sweeping edges includes carbide, to provide reversibility to sweep a ground surface with a second one of the sweeping edges when a first one of the sweeping edges is worn out.

4. The sweeping blade assembly of claim 1 wherein the first-row blades and the second-row blades comprise resilient material bushings including one or more air gaps defined therein for increasing its compressibility, and thus, a movement flexibility of the first-row blades and the second-row blades, and wherein the first-row blades and the second-row blades are secured to the blade support through the resilient material bushings that allow angular and/or vertical movement of the first-row blades and the second-row blades with respect to the blade support.

5. The sweeping blade assembly of claim 1 wherein each one of the first-row blades and the second-row blades comprises two bushing holes, each bushing hole comprising a resilient material bushing and a metal bushing, the metal bushing being for connecting to the blade support and the resilient material bushing being configured to surround the metal bushing for preventing metal to metal contact between the first-row blade or the second-row blade and the blade support.

6. The sweeping blade assembly of claim 1, wherein each of the first-row blades and the second-row blades is independently tiltable with respect to the blade support.

7. A sweeping blade assembly for attachment to a vehicle having a sweeping blade support, the sweeping blade assembly comprising:

a first row of blades comprising a plurality of first-row blades secured to the blade support with adjacent ones of the first-row blades being spaced-apart from each other by a first-row gap; and a second row of blades comprising a plurality of second-row blades secured to the blade support with adjacent ones of the second-row blades being spaced-apart from each other by a second-row gap and being distant from the blade support by the first row of blades, wherein the first-row blades and the second-row blades are unattached to one another;

wherein each one of the first-row gaps is covered by a corresponding one of the second-row blades, thereby preventing formation of an interstice when a blade undergoes movement.

8. The sweeping blade assembly of claim 7, wherein the first-row blades and the second-row blades are substantially rectangular in shapes; and wherein the first-row gap has a first width and the second-row gap has a second width substantially equal to the first width of the first-row gap.at least partially concealed by the module casing and the module base.

9. The sweeping blade assembly of claim 7, wherein each one of the first-row blades and the second-row blades is removably securable to the blade support and has two opposed sweeping edges, each one of the sweeping edges includes carbide, to provide reversibility to sweep a ground surface with a second one of the sweeping edges when a first one of the sweeping edges is worn out.

10. The sweeping blade assembly of claim 7, wherein the first-row blades and the second-row blades comprise resilient material bushings including one or more air gaps defined therein for increasing its compressibility, and thus, a movement flexibility of the first-row blades and the second-row blades, and wherein the first-row blades and the second-row blades are secured to the blade support through the resilient material bushings that allow angular and/or vertical movement of the first-row blades and the second-row blades with respect to the blade support.

11. The sweeping blade assembly of claim 7, wherein each one of the first-row blades and the second-row blades comprises two bushing holes, each bushing hole comprising a resilient material bushing and a metal bushing, the metal bushing being for connecting to the blade support and the resilient material bushing being configured to surround the metal bushing for preventing metal to metal contact between the first-row blade or the second-row blade and the blade support.

12. The sweeping blade assembly of claim 7, wherein each of the first-row blades and the second-row blades is independently tiltable with respect to the blade support.

13. A sweeping blade assembly for attachment to a vehicle having a sweeping blade support, the sweeping blade assembly comprising:

a first row of blades comprising a plurality of first-row blades secured to the blade support with adjacent ones of the first-row blades being spaced-apart from each other by a first-row gap; and a second row of blades comprising a plurality of second-row blades secured to the blade support with adjacent ones of the second-row blades being spaced-apart from each other by a second-row gap and being distant from the blade support by the first row of blades, wherein the second-row blades are partially superposed to adjacent ones of the first-row blades but detached thereof;

wherein each one of the first-row gaps is covered by a corresponding one of the second-row blades, thereby preventing formation of an interstice when a blade undergoes movement.

14. The sweeping blade assembly of claim 13, wherein the first-row blades and the second-row blades are substantially rectangular in shapes; and wherein the first-row gap has a first width and the second-row gap has a second width substantially equal to the first width of the first-row gap.at least partially concealed by the module casing and the module base.

15. The sweeping blade assembly of claim 13, wherein each one of the first-row blades and the second-row blades is removably securable to the blade support and has two opposed sweeping edges, each one of the sweeping edges includes carbide, to provide reversibility to sweep a ground surface with a second one of the sweeping edges when a first one of the sweeping edges is worn out.

16. The sweeping blade assembly of claim 13, wherein the first-row blades and the second-row blades comprise resilient material bushings including one or more air gaps defined therein for increasing its compressibility, and thus, a movement flexibility of the first-row blades and the second-row blades, and wherein the first-row blades and the second-row blades are secured to the blade support through the resilient material bushings that allow angular and/or vertical movement of the first-row blades and the second-row blades with respect to the blade support.

17. The sweeping blade assembly of claim 13, wherein each one of the first-row blades and the second-row blades comprises two bushing holes, each bushing hole comprising a resilient material bushing and a metal bushing, the metal bushing being for connecting to the blade support and the resilient material bushing being configured to surround the metal bushing for preventing metal to metal contact between the first-row blade or the second-row blade and the blade support.

18. The sweeping blade assembly of claim 13, wherein each of the first-row blades and the second-row blades is independently tiltable with respect to the blade support.

* * * * *